US010119286B2

(12) United States Patent
Gleason

(10) Patent No.: US 10,119,286 B2
(45) Date of Patent: Nov. 6, 2018

(54) WAVE PROPAGATION APPARATUS

(71) Applicant: The Florida State University Research Foundation, Inc., Tallahassee, FL (US)

(72) Inventor: Philip Gleason, Tallahassee, FL (US)

(73) Assignee: The Florida State University Research Foundation, Inc., Tallahassee, FL (US)

( * ) Notice: Subject to any disclaimer, the term of this patent is extended or adjusted under 35 U.S.C. 154(b) by 0 days.

(21) Appl. No.: 15/970,094

(22) Filed: May 3, 2018

(65) Prior Publication Data

US 2018/0251992 A1 Sep. 6, 2018

Related U.S. Application Data

(63) Continuation of application No. PCT/US2016/059882, filed on Nov. 1, 2016.

(60) Provisional application No. 62/250,094, filed on Nov. 3, 2015.

(51) Int. Cl.
*E04H 4/00* (2006.01)

(52) U.S. Cl.
CPC ..... *E04H 4/0006* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,287,967 | A | 11/1966 | Laurent | |
| 2007/0040557 | A1 | 2/2007 | Johnstad et al. | |
| 2014/0217734 | A1 | 8/2014 | Peng | |
| 2017/0239580 | A1 * | 8/2017 | Immonen | A63G 31/007 |

OTHER PUBLICATIONS

International Search Report and Written Opinion for PCT/US16/59882 (filing date: Nov. 1, 2016) dated Jan. 12, 2017; Applicant: The Florida State University Research Foundation, Inc.
International Preliminary Report of Patentability for PCT/US16/59882 (filing date: Nov. 1, 2016) dated May 17, 2018; Applicant: The Florida State University Research Foundation, Inc.

* cited by examiner

*Primary Examiner* — Kyle Armstrong
(74) *Attorney, Agent, or Firm* — Molly L. Sauter; Nilay J. Choksi; Smith & Hopen, P.A.

(57) ABSTRACT

A wave propagation apparatus. The apparatus includes a container enclosing a base layer/liquid and an overlying layer/liquid separated from each other. Above the overlying layer is a driver sprocket and a driven sprocket, which rotate about their respective central shafts, which are fixed across a width of the container. A closed chain loop is disposed around the sprockets, with a plurality of paddles secured thereto at a spaced distance away from each other. The chain rotates about the sprockets as they rotate about the central shafts. The driver sprocket rotates via a motor, which is controlled by a controller and powered by a power source. The paddles travel through the overlying layer but not through the base layer, thus displacing the fluid in the overlying layer and causing a dragging wave to appear in the base layer, due to the surface friction between the base layer and the overlying layer.

17 Claims, 12 Drawing Sheets

WAVE PROPAGATION APPARATUS

CROSS-REFERENCE TO RELATED APPLICATIONS

This application is a continuation and claims priority to International Patent Application No. PCT/US2016/059882, entitled "WAVE PROPAGATION APPARATUS", filed Nov. 1, 2016 by the same inventor, which claims priority to U.S. Provisional Patent Application No. 62/250,094, entitled "Wave Propagation Device and Method of Use Thereof", filed Nov. 3, 2015, the entirety of which are incorporated herein by reference.

BACKGROUND OF THE INVENTION

1. Field of the Invention

This invention relates, generally, to wave propagation devices. More specifically, it relates to a wave propagation wheel that produces aesthetically-pleasing rolling waves.

2. Brief Description of the Prior Art

Devices exist to produce rolling waves of fluid within a containment apparatus. However, most, if not all, of these conventional devices require that the underlying tank/containment apparatus must be tilted or otherwise moved to maintain the rolling waves.

Accordingly, what is needed is a device, system, and/or methodology for creating continuous rolling, dragging waves that are aesthetically-pleasing without having to tilt or move the underlying tank. However, in view of the art considered as a whole at the time the present invention was made, it was not obvious to those of ordinary skill in the field of this invention how the shortcomings of the prior art could be overcome.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an improved wave propagation apparatus is now met by a new, useful, and nonobvious invention.

In an embodiment, the current invention is a wave propagation apparatus that includes a containment apparatus and one or more elongate paddles within that containment apparatus. Also enclosed within the containment apparatus is a base fluid and an overlying fluid, where the overlying fluid has a density that is lower than a density of the base fluid, so they remain separate with the overlying fluid above the base fluid. The paddles are rotatably positioned above the fluids (e.g., via a gear and chain assembly) and have a length so that they enter the overlying fluid but not the base fluid. This creates a dragging wave in the base fluid during rotation, due to displacement of the overlying fluid by the paddles and due to a surface tension between the base fluid and overlying fluid. If a gear and chain assembly is used, a plurality of paddles can be positioned along the chain at intervals, which in turn determines a frequency of dragging waves created in the overlying fluid.

In a separate embodiment, the current invention is a wave propagation apparatus. The apparatus includes a container having a width and a length, along with a bottom side and a plurality of vertical sidewalls. A base layer/liquid is disposed within the container, and an overlying layer/liquid is disposed within the container on top of the base layer. The base layer (e.g., dyed water) and overlying layer (e.g., oil, mineral oil) should be such that they are homogenized or admixed within the container. The layers stably remain in separate distinct layers (e.g., due to the overlying layer having a lower density than the base layer) within the container with the overlying layer being in contact with the base layer above the base layer. The apparatus further includes a pair of central shafts positioned across the width of the container at a spaced distance above the overlying layer. A driver wheel (e.g., gear, roller, sprocket) is disposed around one central shaft, and another (typically driven) wheel (e.g., gear, roller, sprocket) is disposed around the other central shaft, where the wheels are rotatable about the central shafts. A motor drives rotation of the driver wheel, and a power source powers the motor.

The apparatus further includes a closed belt or chain loop disposed around the wheels above the overlying layer, such that the belt/chain loops does not contact the overlying layer. It is positioned in substantially parallel relation to the container's length. The belt/chain loop rotates about the wheels during rotation of the wheels. One or more elongate paddles, which can be straight or curved, are secured to the belt/chain loop and extend outwardly (e.g., perpendicularly) from the belt/chain loop. The paddles contact and travel through the overlying layer during rotation of the belt/chain loop, where the paddles do not contact the base layer. In this way, the paddles displace the overlying layer during rotation of the belt/chain loop, thus creating a dragging wave in the base layer, due to the surface tension between the base layer and overlying layer.

Optional to the paddles, each paddle can include two flanges that are secured on each side of the chain/belt loop. Each paddle can then be secured to the chain via a cotter pin disposed through the chain and through apertures in each flange of each paddle.

If a plurality of paddles is secured to the belt/chain loop, the paddles can be positioned at intervals along the belt/chain loop. Further, when this plurality includes a pair of paddles, each paddle is disposed at an end of the belt/chain loop, such that during rotation of the belt/chain loop, when one paddle is disposed at or near the driver wheel, the other paddle is disposed at or near the other wheel.

In a separate embodiment, the current invention is wave propagation apparatus that includes any one or more—or even all—of the foregoing features described.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a", "an", and "the" include plural referents unless the content clearly dictates otherwise. As used in this specification and the appended claims, the term "or" is generally employed in its sense including "and/or" unless the context clearly dictates otherwise.

Figure 1:
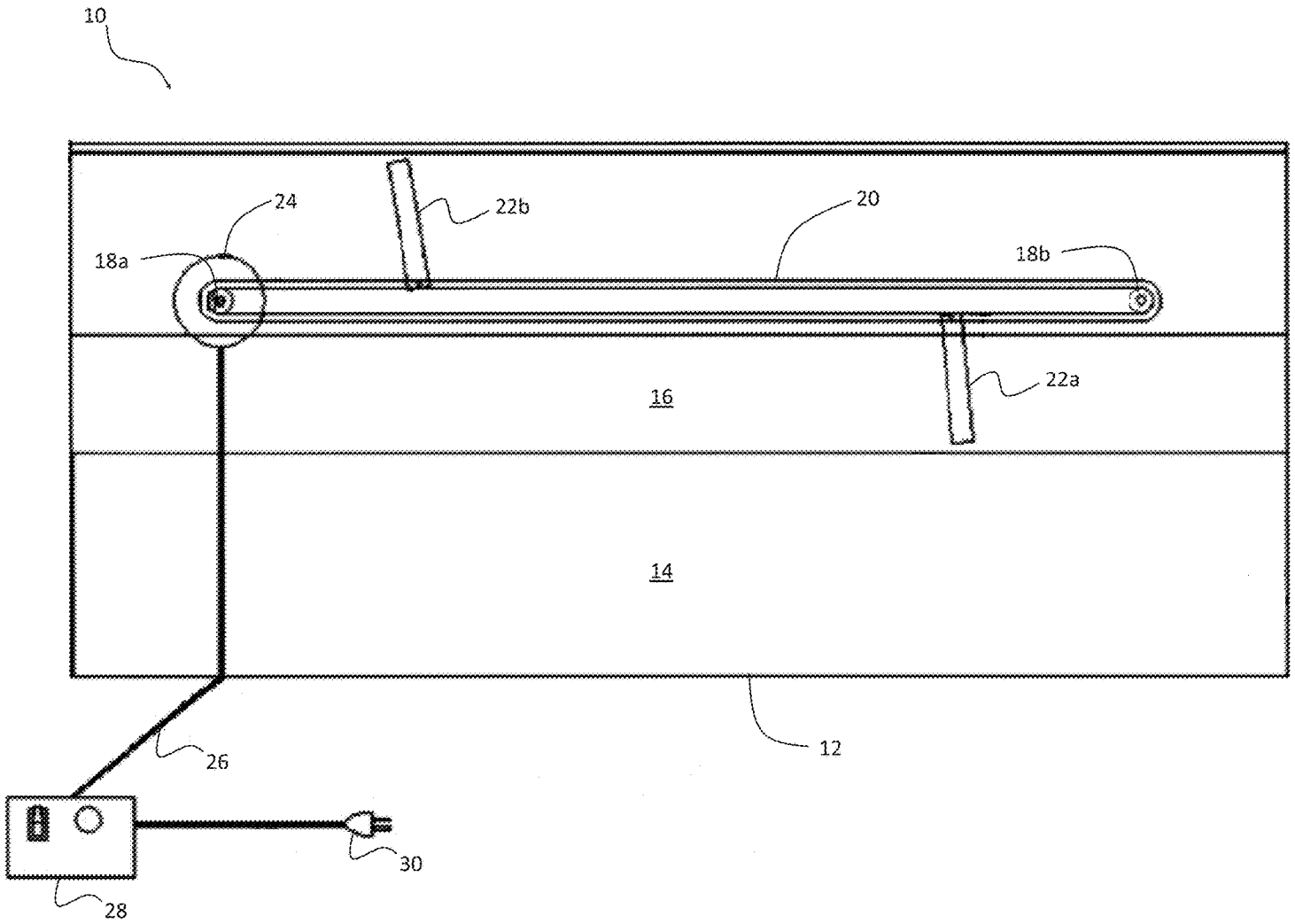
FIG. 1 is a schematic of a wave propagation apparatus, according to an embodiment of the current invention.

In an embodiment, as seen in FIG. 1, the current invention is a wave propagation apparatus, generally denoted by the reference numeral 10. Apparatus 10 includes container 12 that encloses base layer 14 and overlying layer 16 from the bottom and vertical sides; the top of container 10 can be open or closed. Container 12 typically has transparent sides so that the resulting wave can be viewed from outside of container 12.

Base layer 14 is formed of a fluid that has a particular density, and overlying layer 16 also is formed of a fluid that has a particular density, where the density of overlying layer 16 is lower than the density of base layer 14. For example, base layer 14 can be a base layer of water dyed to a desired color for easier observation of the generated wave, and overlying layer 16 can be an overlying layer of transparent oil. In this way, base layer 14 and overlying layer 16 do not admix or homogenize with one another, with overlying layer 16 stably disposed in overlying relation to base layer 14.

An example of base layer 14 is a base layer of water, and an example of overlying layer 16 is an overlying fluid layer of oil. Base layer 14 may be deionized water dyed to a desired color for easier observation of the generated wave, or base layer 14 may include a phosphorescent additive or any other additive to distinguish base fluid layer 14 from overlying fluid layer 16. Further, glycerin may be added to provide a different surface tension. The two layers 14, 16 may be any combination of fluids, so long as the fluids are capable of maintaining separate layers, even while overlying layer 16 is disturbed. This can be accomplished, for example, by overlying layer 16 having a lower density than base layer 14, as discussed. Regardless of the mechanism, overlying layer 16 should be capable of being positioned above base layer 14 without homogenizing with base layer 14. It is noted that when wave propagation apparatus 10 is active/in operation, the wave is formed in base layer 14. This will become clearer as this specification continues.

Apparatus 10 further includes driver gear/roller/chain sprocket 18*a* and driven gear/roller/chain sprocket 18*b*, each securely disposed within container 12 at an equal distance above overlying layer 16 via shafts (not shown in FIGS. 1 and 2A-2B but seen in FIGS. 3A-3C) that are positioned across a width of container 12. Gears/rollers/chain sprockets 18*a*, 18*b* shall hereinafter be referred to as "sprockets", though it should be understood that these terms each refer to the same mechanism and functionality, regardless of the particular structure used. Sprockets 18*a*, 18*b* are thus fixedly disposed at an equal height above overlying layer 16 and are rotatable about their respective central shafts.

Closed belt or chain loop 20 is disposed around sprockets 18*a*, 18*b* above overlying layer 16 and rotates about sprockets 18*a*,18*b* as sprockets 18*a*, 18*b* rotate about their respective central shafts. Chain 20 may be taut between sprockets 18*a*, 18*b* or may have slack, depending on needs of the user, though chain 20 should not contact overlying layer 16. A plurality of paddles (e.g., typically a pair) 22*a*, 22*b* are secured to chain 20 at spaced intervals, where the intervals may be adjusted to determine the frequency at which the resulting waves are produced, as will become clearer as this specification continues. In an embodiment, paddles 22*a*, 22*b* are secured to chain 20 in a manner such that when paddle 22*a* is at or in proximity to sprocket 18*a* during rotation of chain 20, paddle 22*b* is at or in proximity to sprocket 18*b*. In other words, paddles 22*a*, 22*b* are disposed at opposite ends of chain 20 along the length of chain 20, as indicated in FIG. 1. This provides a continuous dragging wave within container 12. See FIGS. 4A-4F for example.

Figure 2A:
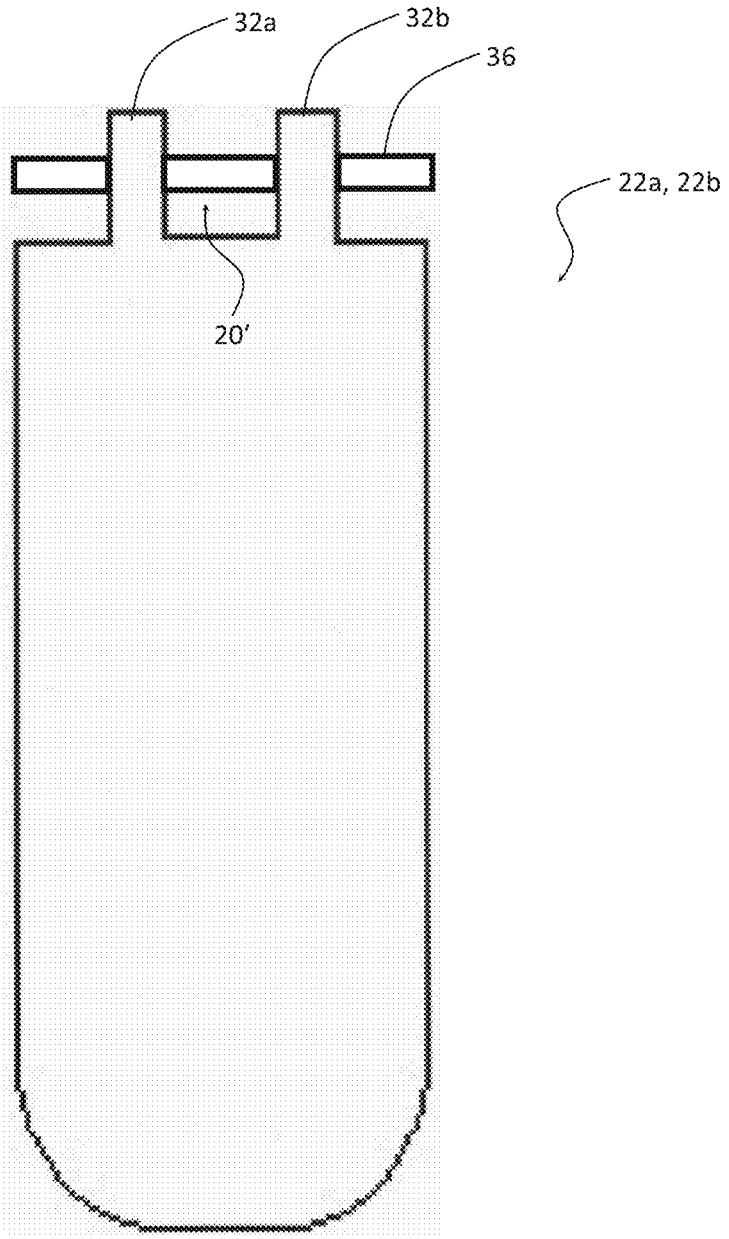
FIG. 2A is a left/right side view of a paddle as used in a wave propagation apparatus, according to an embodiment of the current invention.
Figure 2B:
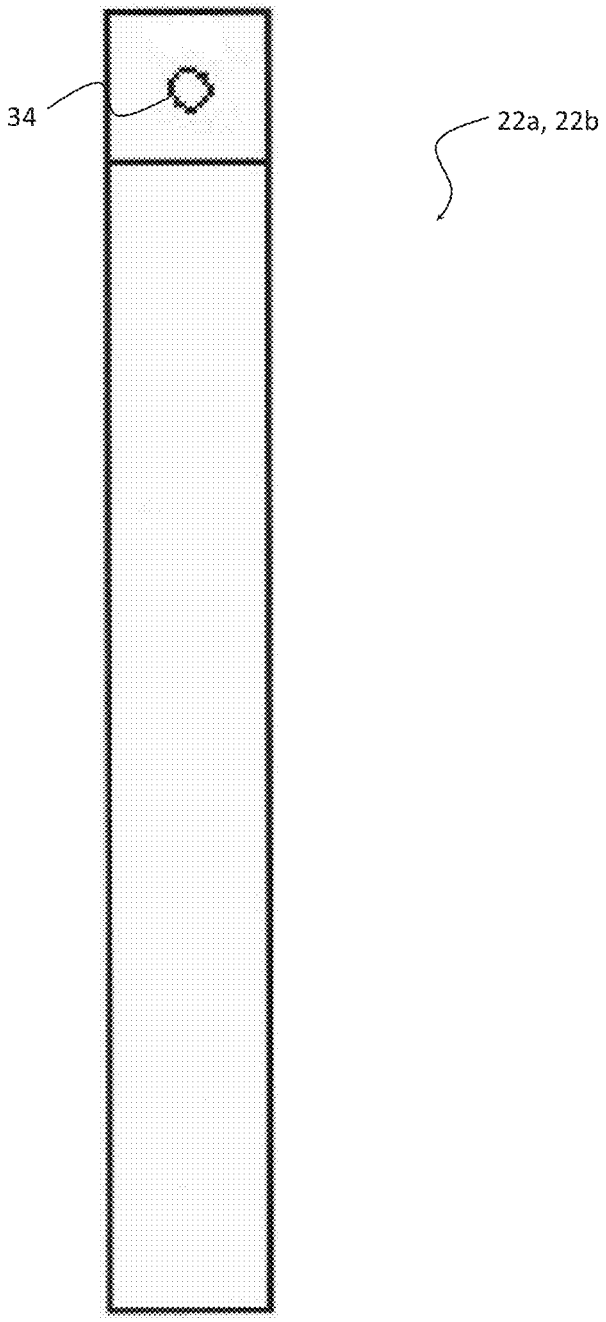
FIG. 2B is a front/rear side view of the paddle of FIG. 2A.

Close-up isolated views of paddles 22*a*, 22*b* are shown in FIGS. 2A-2B. Each paddle 22*a*, 22*b* includes flanges 32*a*, 32*b* with apertures 34 disposed through each flange 32*a*, 32*b* and aligned with each other. Pin 36 is inserted through apertures 34. For clarity, FIG. 2A is shown without chain 20 in place; chain 20 would be positioned between flanges 32*a*, 32*b* at reference numeral 20'. Thus, pin 36 would also be disposed through chain 20, along with both flanges 32*a*, 32*b*, thus securing paddles 22*a*, 22*b* to chain 20. In certain embodiments, paddles 22*a*, 22*b* are fixed in place on chain 20 (i.e., they are not rotatable about chain 20) and extend in a direction substantially normal to the direction of travel of the respective chain link on which paddle 22*a*, 22*b* are secured. Alternatively, paddles 22*a*, 22*b* may pivot about chain 20 when traveling through overlying layer 16 but not to the extent that the wave within base layer 14 is affected aesthetically.

Rotation of driver sprocket 18*a* is controlled and powered via conventional methods, such as by motor 24 in communication 26 with controller 28, which, in turn, is powered by power source 30. Controller 28 can include not only an on/off switch but also a mechanism of controlling the rate of rotation of sprockets 18*a*, 18*b*.

As noted, during operation of wave propagation apparatus 10, motor 24 actuates the rotation of sprockets 18*a*, 18*b*, which, in turn, causes rotation of chain 20 about sprockets 18*a*, 18*b*. Paddles 22*a*, 22*b* travel with chain 20 during such rotation in a manner that paddles 22*a*, 22*b* contact overlying layer 16. Paddles 22*a*, 22*b* pass into and through overlying layer 16 but not into and through base layer 14. In this way, paddles 22*a*, 22*b* forces overlying layer 16 in a predetermined direction as chain 20 rotates. As each paddle 22*a*, 22*b* traverses through overlying layer 16 and forces overlying layer 16 in the predetermined direction, the surface tension between overlying layer 16 and base layer 14 causes base layer 14 to draft behind paddle 22*a*, 22*b*, thus forming a dragging wave in base layer 14.

Example 1

Figure 3A:
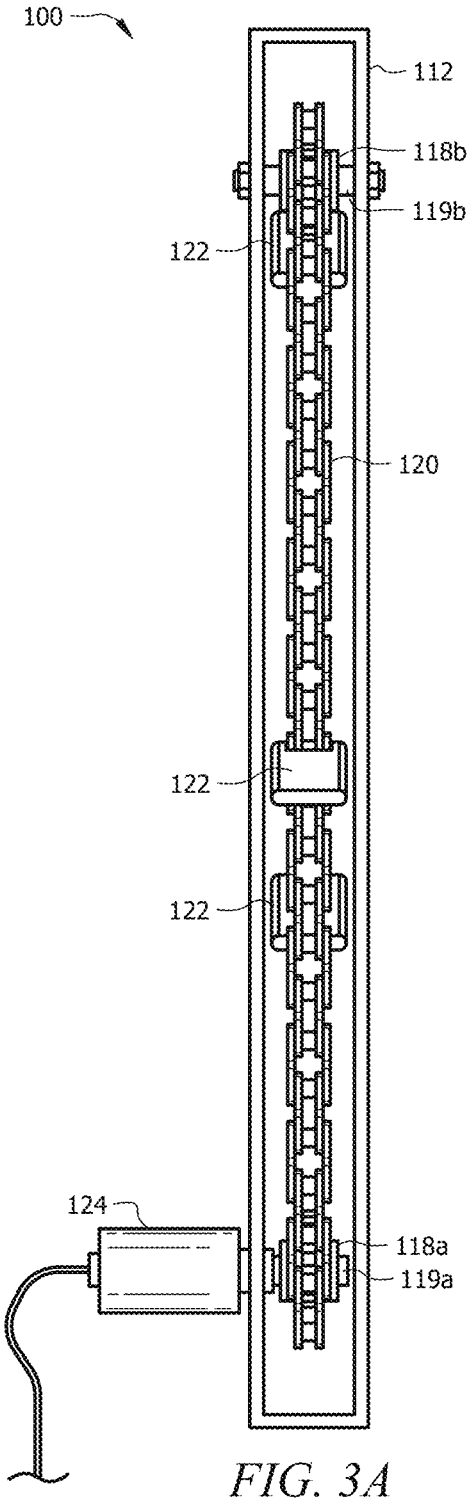
FIG. 3A is an elevated top view of a wave propagation apparatus, according to an embodiment of the current invention.
Figure 3B:
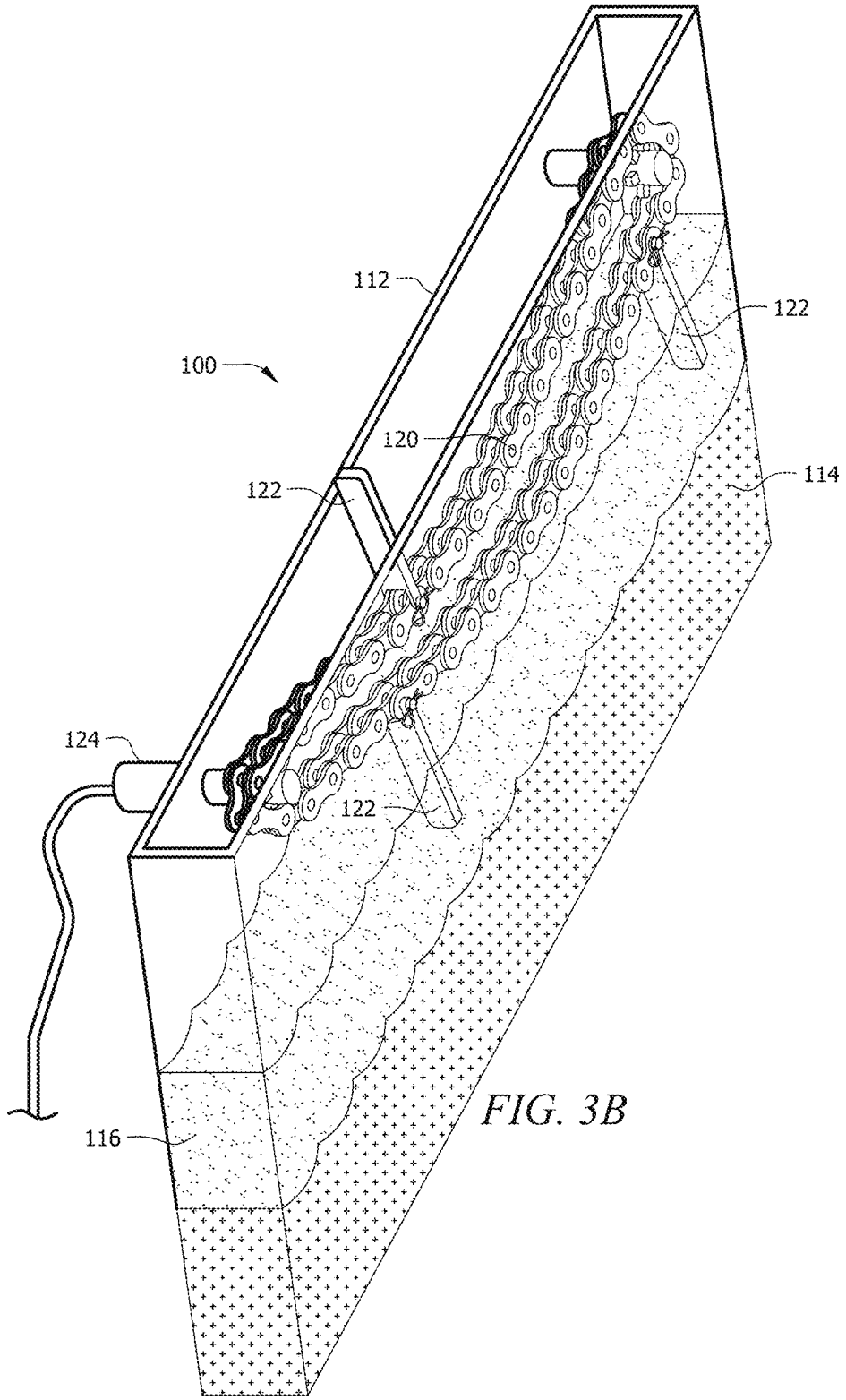
FIG. 3B is a side perspective view of the wave propagation apparatus of FIG. 3A.
Figure 3C:
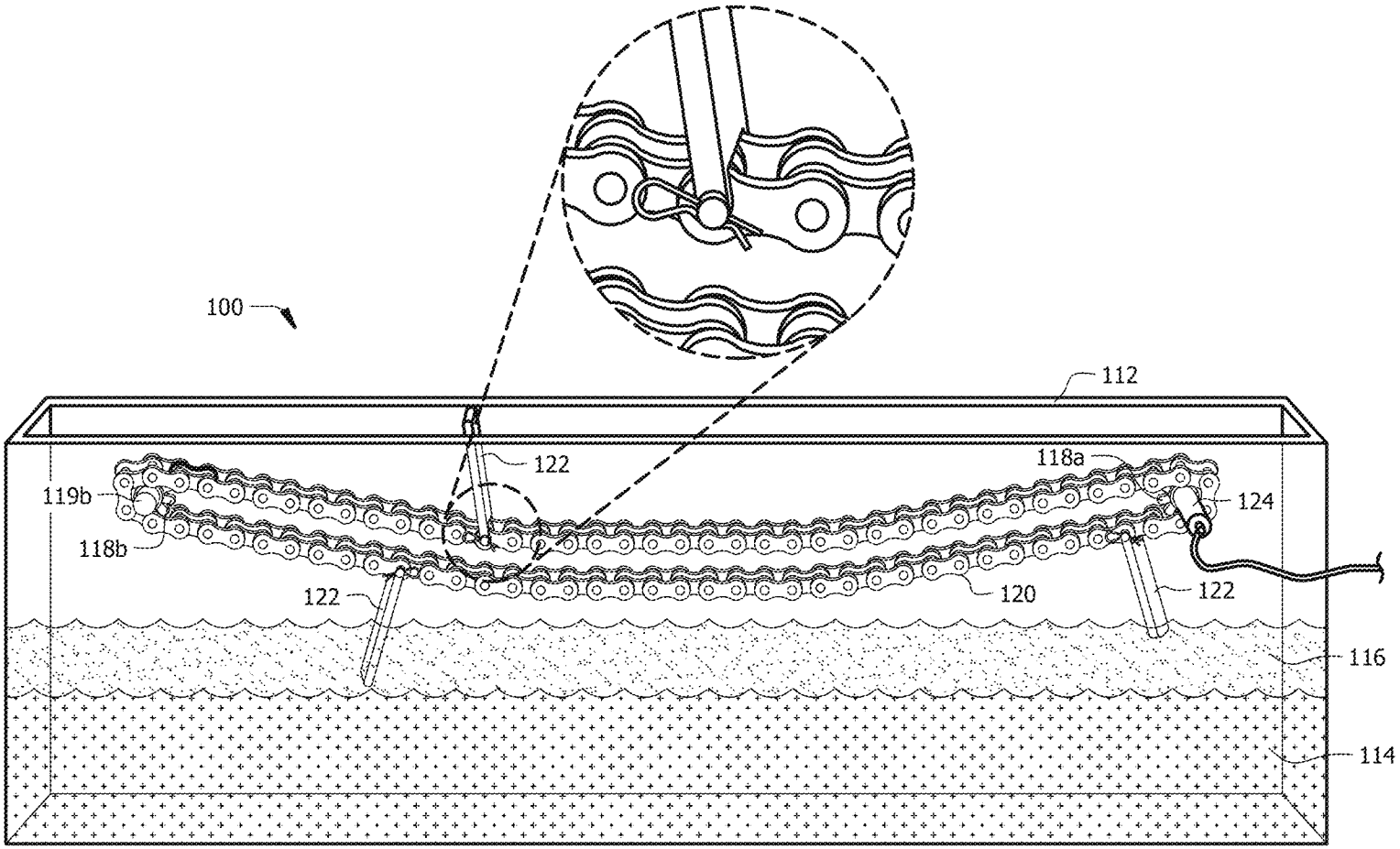
FIG. 3C is a front perspective view of the wave propagation apparatus of FIG. 3A.
Figure 4A:
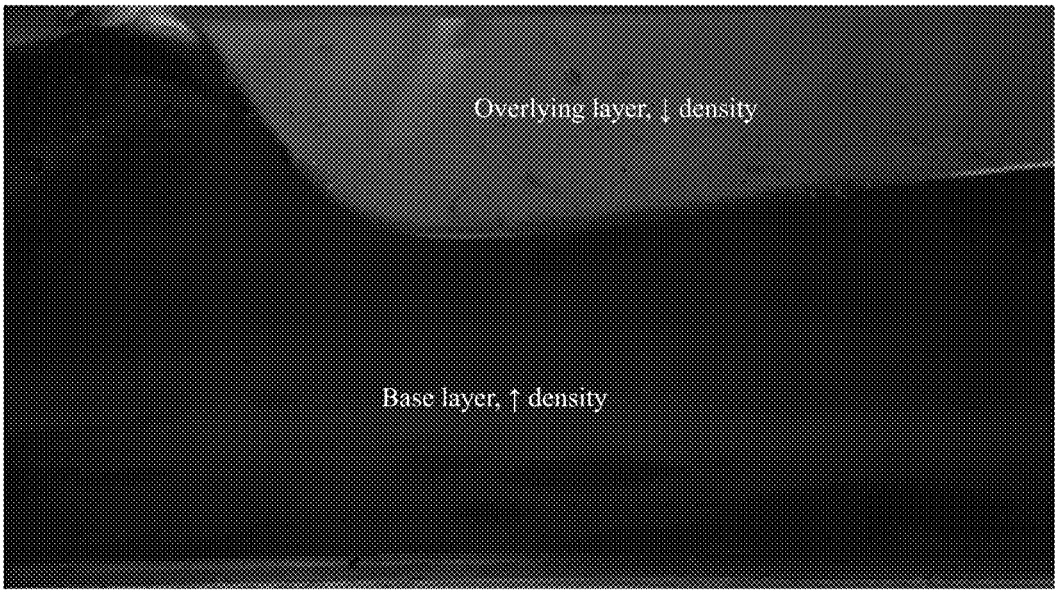
FIG. 4A depicts a stage in the cycle of an exemplary continuous wave created using the device and methodology of the current invention.
Figure 4B:
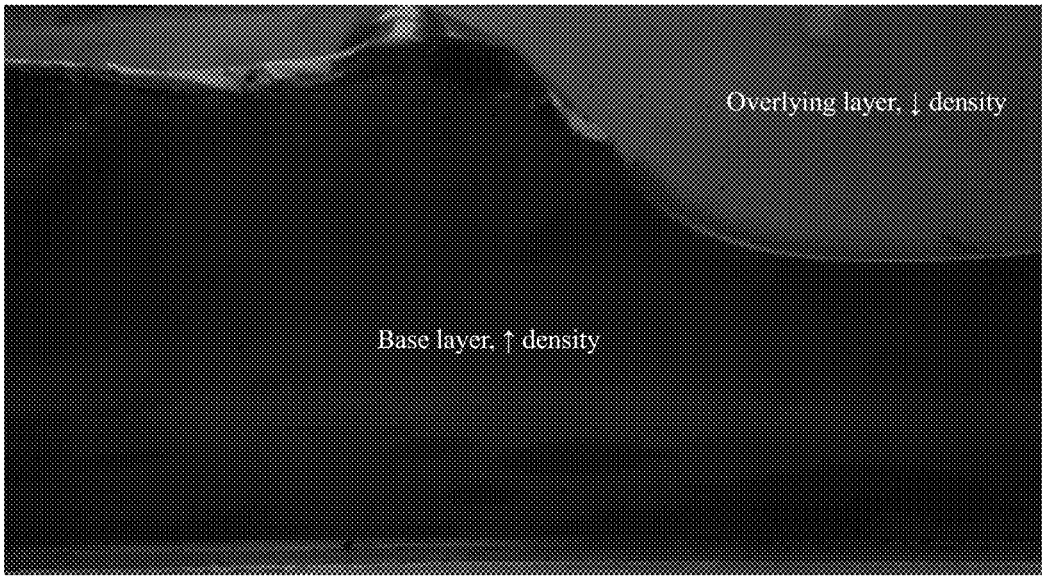
FIG. 4B depicts a stage in the cycle of the exemplary continuous wave of FIG. 4A, where this stage is subsequent to the stage seen in FIG. 4A.
Figure 4C:
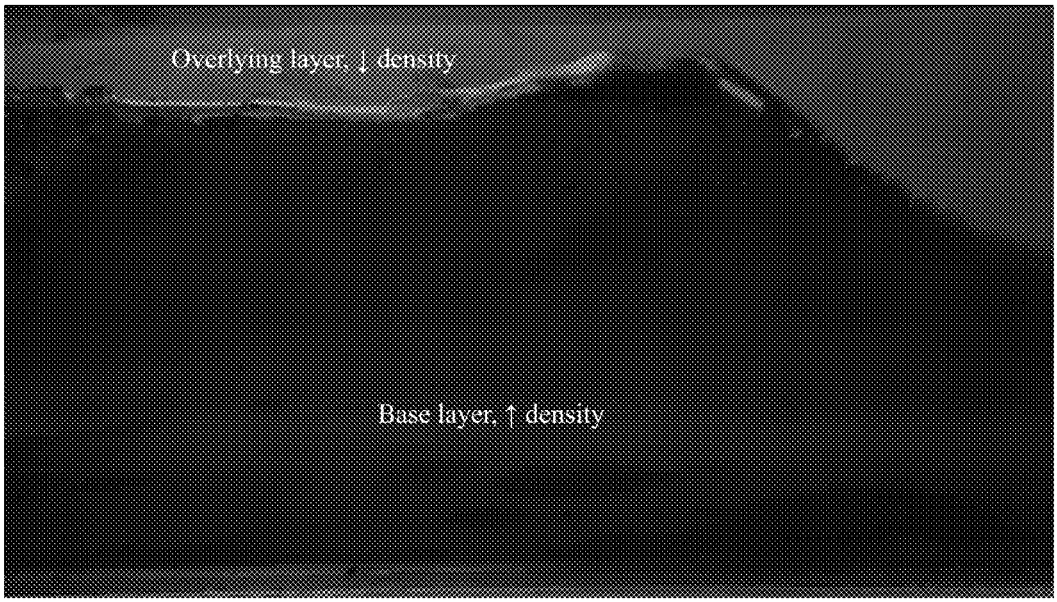
FIG. 4C depicts a stage in the cycle of the exemplary continuous wave of FIG. 4A, where this stage is subsequent to the stage seen in FIG. 4B.
Figure 4D:
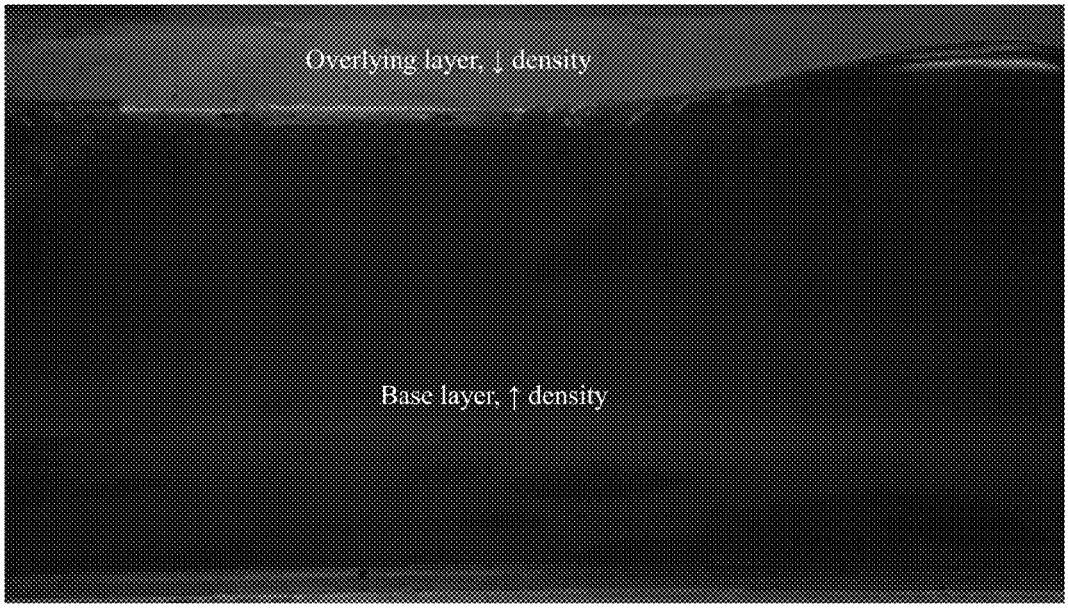
FIG. 4D depicts a stage in the cycle of the exemplary continuous wave of FIG. 4A, where this stage is subsequent to the stage seen in FIG. 4C.
Figure 4E:
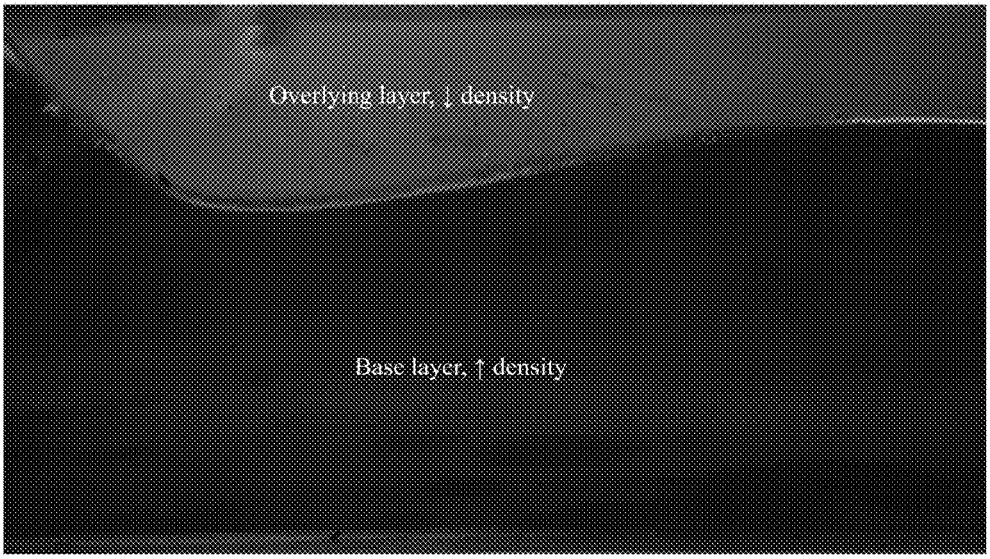
FIG. 4E depicts a stage in the cycle of the exemplary continuous wave of FIG. 4A, where this stage is subsequent to the stage seen in FIG. 4D.
Figure 4F:
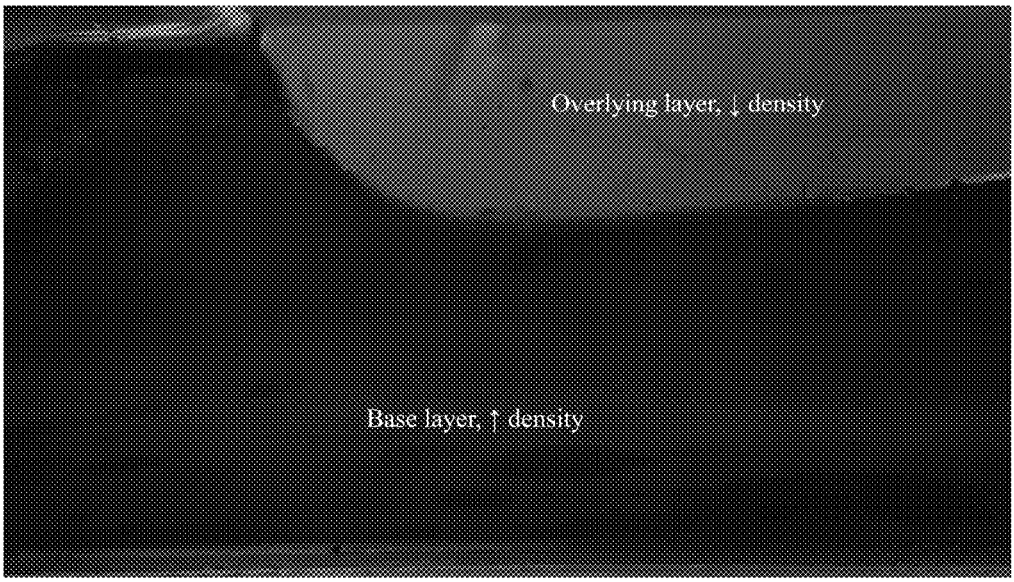
FIG. 4F depicts a stage in the cycle of the exemplary continuous wave of FIG. 4A, where this stage is subsequent to the stage seen in FIG. 4E.

In an embodiment, as seen in FIGS. 3A-3C, the current invention includes an acrylic box containing a mechanism created to propagate a continuous wave for artistic display. The mechanism includes a paddle wheel that moves through a layer of oil at the surface tension of the underlying water. The draft from the surface tension of the water creates a dragging wave. This drive chain mechanism creates this wave effect in continuum.

More specifically, FIGS. 3A-3C depicts wave propagation apparatus 100 including container 112 enclosing base layer 114 and overlying layer 116 separated from each other. Above overlying layer 116 is driver sprocket 118*a* and driven sprocket 118*b*, which rotate about central driver shaft 119*a* and central driven shaft 119*b*, respectively, which are fixed across a width of container 112. Closed chain loop 120 is disposed around sprockets 118*a*, 118*b*, with a plurality of paddles 122 secured thereto at a spaced distance away from each other. Chain 120 rotates about sprockets 118*a*, 118*b* as sprockets 118*a*, 118*b* rotate about central shafts 119*a*, 119*b*. Driver sprocket 118*a* rotates via motor 124, which is controlled by a controller (not shown in this figure but seen in FIG. 1) and powered by a power source (not shown in this figure but seen in FIG. 1). Paddles 122 travel through overlying layer 116 but not through base layer 114, thus displacing the fluid in overlying layer 116 and causing a dragging wave (see FIGS. 4A-4F) to appear in base layer 114, due to the surface friction between base layer 114 and overlying layer 116.

A prototype of an embodiment of the current invention was fabricated using the following non-limiting components and dimensions:

1. Gear motor (e.g., 12 vdc @ 150 rpm) with speed controller to tune wave to desired height
2. Roller chain (e.g., 56" in length) for continuous paddle movement
3. 2 sprockets (matching roller chain)
4. Motor mounted sprocket center pin (e.g., 28") on center to idle pin
5. 2-3 paddles made from clear acrylic and held onto the chain with a thru pin and cotter—number of paddles control the frequency of the wave and thus can be altered depending on frequency of the wave desired
6. Clear acrylic box (e.g., 1.5"×16"×36")
7. Mineral oil layer—may be deeper but necessitates a change in the length of the paddle. Other oils, such as silicone oil, are contemplated herein for different surface tension, as desired.
8. Water layer (e.g., deionized water)—may be dyed a desired color. Difference phosphorescent additives were studied for color glow, along with glycerin additive for different surface tensions.
9. Acrylic lid (e.g., 0.25"×2"×36.5")—keeps oil from splashing outside the box
10. Power cord from motor to control box
11. Control Box with actuator (e.g., on/off switch) and variable speed controller. At the right speed, the wave peaks without breaking (breaking wave creates issues with mixing the oil and water).
12. Power line to outlet or other power source
13. Paddle-to-surface distance—this very slight gap is critical to the formation of the wave. The paddle sweeps the prevailing current of surface tension upwards in its draft.
14. 2 bearings to fit both sides of the pin—creates an easily spinning idle pin.

To construct the apparatus, the acrylic tank was provided, and holes were drilled at about 28 inches on center and about 4¼ inches from the top of the tank. The chain was unpinned in three (3) locations to attach three (3) acrylic paddles. Then the ⅛" pins inserted through the acrylic paddles can be fastened with cotter pins.

The chain was installed around the sprockets and connected to the motor. The chain was stretched tight, and the idle pin was inserted through the bearing, sprocket, and other bearing. Then the sprocket was tightened to pin with the set screw.

Dyed deionized water was then added to just below the paddle line. It is contemplated that the water can be clean and sterile to provide a proper, continuous wave. The mineral oil was then added under just under the chain line. The oil would continually lubricate the chain. It is recommended to fully flush the grease off the chain before installation, as the grease may come off in the oil and discolor the oil.

The current invention contemplates several variables to change the resulting wave. For example, an inclined bottom was tested. By creating wedge acrylic shapes to fit the bottom of the tank, wave motions and height of wave can be controlled.

Different shapes of paddles were also tested. Forward curved/bent paddles, straight paddles, and backward curved/bent acrylic paddles were used. The straight paddles showed the best results for continuous repeating wave for display. A half-inch paddle thickness was used/desired for its strength and clarity.

Regarding motor speed, the foregoing apparatus used a 150 rpm motor, though the top end of the speed appeared to create a break that stirred up the mixture. This can be avoided at lower speeds.

It is contemplated that the foregoing apparatus can be proportionally scaled larger to create larger and more aesthetically-pleasing waves.

It is further contemplated that the invention may include a tensioner or lateral channel for the motor pin or idle pin to adjust the tension.

Glossary of Claim Terms

Closed belt or chain loop: This term is used herein to refer to a band or similar structural component that is capable of engaging a wheel/gear/roller/sprocket, such that it moves or loops around the wheel/gear/roller/sprocket during rotation of the wheel/gear/roller/sprocket.

Separate distinct layers: This term is used herein to refer to materials (fluids) that remain heterogeneous even when contacting each other, such that the materials are easily discernible or can be easily perceived by an individual observing the materials.

Substantially parallel: This term is used herein to refer to two or more components having dimensions that are disposed along the same plane or at least close enough to being disposed along the same plane that the resulting wave of the current invention is not affected aesthetically.

Substantially perpendicular: This term is used herein to refer to two or more components having dimensions that are disposed at a 90° angle to each other or at least close enough to being disposed at a 90° angle to each other that the resulting wave of the current invention is not affected aesthetically.

Wheel: This term is used herein to refer to a gear, roller, sprocket, or similar structural component that rotates about a central shaft and engages a belt or chain loop to permit rotation of such belt or chain loop.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A wave propagation apparatus, comprising:

a container having a length and a width, said container further having a bottom side and a plurality of vertical sidewalls;

a base layer formed of a first liquid, said base layer having contact with said bottom side and said plurality of vertical sidewalls of said container;

an overlying layer formed of a second liquid, said overlying layer having contact with said plurality of vertical sidewalls of said container but not with said bottom side of said container, wherein said base layer and said overlying layer are not homogenized or admixed within said container, such that said base layer and said overlying layer stably remain in separate distinct layers within said container with said overlying layer being in contact with said base layer and in overlying relation to said base layer;

a pair of central shafts positioned across said width of said container at a spaced distance above said overlying layer;

a driver wheel disposed around one of said pair of central shafts above said overlying layer;

a second wheel disposed around the other of said pair of central shafts above said overlying layer, wherein said driver wheel and said second wheel are rotatable about said pair of central shafts;

a motor that drives rotation of said driver wheel;

a power source that powers said motor;

a closed belt or chain loop disposed around said driver wheel and said second wheel above said overlying layer, such that said closed belt or chain loop does not contact said overlying layer, said closed belt or chain loop positioned in substantially parallel relation to said length of said container, wherein said closed belt or chain loop rotates about said driver wheel and said second wheel during rotation of said driver wheel and said second wheel; and one or more elongate paddles secured to said belt or chain loop and extending outwardly from said belt or chain loop, wherein said one or more elongate paddles contact and travel through said overlying layer during rotation of said closed belt or chain loop, wherein said one or more elongate paddles does not contact said base layer, said one or more paddles displacing said overlying later during rotation of said belt or chain loop, thus creating a dragging wave in said base layer, due to a surface tension between the base layer and said overlying layer.

2. A wave propagation device as in claim 1, wherein a density of said second liquid is lower than a density of said first liquid, such that said second liquid floats on top of said first liquid.

3. A wave propagation device as in claim 1, wherein said driver wheel is a sprocket, said second wheel is a sprocket, and said belt or chain loop is a chain disposed around said sprockets.

4. A wave propagation device as in claim 3, wherein each of said one or more paddles includes two flanges that are secured on each side of said chain.

5. A wave propagation device as in claim 4, wherein said each paddle is secured to said chain via a cotter pin disposed through said chain and through apertures in each flange of said each paddle.

6. A wave propagation device as in claim 1, wherein said one or more paddles extend from said belt or chain loop in a substantially perpendicular direction.

7. A wave propagation device as in claim 1, wherein said one or more paddles are straight.

8. A wave propagation device as in claim 1, wherein said one or more paddles includes a plurality of paddles disposed at intervals along said belt or chain loop.

9. A wave propagation device as in claim 8, wherein said plurality of paddles is a pair of paddles each disposed at an end of said closed belt or chain loop, such that during rotation of said belt or chain loop, when one of said paddles is disposed at or near said driver wheel, the other of said paddles is disposed at or near said second wheel.

10. A wave propagation device as in claim 1, wherein said second wheel is a driven wheel that rotates due to rotation of said driver wheel.

11. A wave propagation device as in claim 1, wherein said first liquid is dyed water.

12. A wave propagation device as in claim 11, wherein said second liquid is oil.

13. A wave propagation device as in claim 12, wherein said oil is mineral oil.

14. A wave propagation apparatus, comprising:

a container having a length and a width, said container further having a bottom side and a plurality of vertical sidewalls;

a base layer formed of a first liquid, said base layer having contact with said bottom side and said plurality of vertical sidewalls of said container, said first liquid being dyed water;

an overlying layer formed of a second liquid, said overlying layer having contact with said plurality of vertical sidewalls of said container but not with said bottom side of said container, said second liquid being mineral oil, wherein a density of said second liquid is lower than a density of said first liquid, such that said second liquid floats on top of said first liquid, wherein said base layer and said overlying layer are not homogenized or admixed within said container, such that said base layer and said overlying layer stably remain in separate distinct layers within said container with said overlying layer being in contact with said base layer and in overlying relation to said base layer;

a pair of central shafts positioned across said width of said container at a spaced distance above said overlying layer;

a driver sprocket disposed around one of said pair of central shafts above said overlying layer;

a driven sprocket disposed around the other of said pair of central shafts above said overlying layer, wherein said driver sprocket and said driven sprocket are rotatable about said pair of central shafts;

a motor that drives rotation of said driver sprocket;

a power source that powers said motor;

a closed chain loop disposed around said driver sprocket and said driven sprocket above said overlying layer, such that said closed chain loop does not contact said overlying layer, said closed chain loop positioned in substantially parallel relation to said length of said container, wherein said closed chain loop rotates about said driver sprocket and said driven sprocket during rotation of said driver sprocket and said driven sprocket; and a pair of elongate, straight paddles secured to said chain loop and extending outwardly from said chain loop in a substantially perpendicular direction, wherein said pair of elongate paddles contact and travel through said overlying layer during rotation of said closed chain loop, wherein said pair of elongate paddles does not contact said base layer, wherein each of said pair of paddles is disposed at an end of said closed chain loop, such that during rotation of said chain loop, when one of said paddles is disposed at or near said driver sprocket, the other of said paddles is disposed at or near said driven sprocket, wherein said each paddle includes two flanges that are secured on each side of said chain loop, wherein said each paddle is secured to said chain via a cotter pin disposed through said chain and through apertures in each flange of said each paddle, said pair of each displacing said overlying later during rotation of said chain loop, thus creating a dragging wave in said base layer, due to a surface tension between the base layer and said overlying layer.

15. A wave propagation device, comprising:

a containment apparatus containing a base fluid and an overlying fluid, said base fluid having a first density and said overlying fluid having a second density that is lower than said first density, such that said base fluid and said overlying fluid remain separate with said overlying fluid remaining stable in overlying relation to said base fluid; and one or more elongate paddles rotatably positioned above said base fluid and said overlying fluid, said one or more elongate paddles having a length so that said one or more elongate paddles enters said overlying fluid but does not enter said base fluid, said one or more paddles creating a dragging wave in said base fluid during rotation at a predetermined speed, due to displacement of said overlying fluid by said one or more paddles and due to a surface tension between said base fluid and said overlying fluid.

16. A wave propagation device as in claim 15, wherein said one or more elongate paddles rotatably positioned above said base fluid and said overlying fluid a gear and chain assembly.

17. A wave propagation device as in claim 16, wherein said one or more paddles are a plurality of paddles positioned along a chain of said gear and chain assembly at a predetermined spaced distance apart to affect a frequency of dragging waves created in said overlying fluid.

* * * * *